United States Patent [19]

Okamoto et al.

[11] Patent Number: 4,556,038

[45] Date of Patent: Dec. 3, 1985

[54] SUPERCHARGED INTERNAL COMBUSTION ENGINE HAVING CONTROL MEANS RESPONSIVE TO ENGINE SPEED AND ACCELERATOR PEDAL VELOCITY

[75] Inventors: Toshiaki Okamoto, Okazaki; Tomio Oguma, Anjo; Matasaburo Kaga, Nishio, all of Japan

[73] Assignee: Aisin Seiki Kabushiki Kaisha, Kariya, Japan

[21] Appl. No.: 564,161

[22] Filed: Dec. 22, 1983

[30] Foreign Application Priority Data

Mar. 4, 1983 [JP] Japan ..... 58-34647
Mar. 4, 1983 [JP] Japan ..... 58-34648

[51] Int. Cl.[4] ..... F02D 23/00
[52] U.S. Cl. ..... 123/564; 60/602
[58] Field of Search ..... 60/600, 601, 602, 603, 60/611; 123/564

[56] References Cited

U.S. PATENT DOCUMENTS 4,459,808 7/1984 Rydquist et al. ..... 60/602
4,467,607 8/1984 Rydquist et al. ..... 60/602

FOREIGN PATENT DOCUMENTS 146023 9/1982 Japan ..... 60/602

*Primary Examiner*—Michael Koczo
*Attorney, Agent, or Firm*—Burns, Doane, Swecker and Mathis

[57] ABSTRACT

An apparatus for controlling a supercharger driven by an engine or exhaust gas is controlled in response to primarily the changing rate of accelerator (pedal) position, and additional parameters such as time after supercharging start and/or vehicle speed and transmission gear shift position, etc. so that it can precisely respond to the acceleration requirements by the driver with good accelerating performance and fuel economy.

8 Claims, 11 Drawing Figures

SUPERCHARGED INTERNAL COMBUSTION ENGINE HAVING CONTROL MEANS RESPONSIVE TO ENGINE SPEED AND ACCELERATOR PEDAL VELOCITY

FIELD OF THE INVENTION

The present invention relates to an apparatus for controlling a supercharger which serves to supercharge an engine with intake air and, in particular, to a supercharger controlling apparatus which precisely responds to acceleration requirements for a vehicle.

BACKGROUND OF THE INVENTION

Conventional control of the superchargers has been carried out in response to accelerator (pedal) position or throttle opening. Accordingly the conventional control has disadvantages in that supercharging cannot be effected even when it is needed in view of the state of the accelerator or supercharging cannot be stopped even when it is not necessary.

Namely, such disadvantages entail further drawbacks that a sufficient supercharging performance corresponding to the supercharging ability cannot be attained and that unnecessary supercharging brings about waste in fuel consumption.

SUMMARY OF THE DISCLOSURE

Therefore it is an object of the present invention to provide a novel apparatus for controlling a supercharger, which is free of the aforementioned disadvantages.

It is another object of the present invention to provide an apparatus for controlling a supercharger so as to operate it only when supercharging is needed by appropriately detecting such need for acceleration.

In the present invention the necessity of supercharging is determined by detecting the changing rate of accelerator position or throttle opening and discriminating the necessity of supercharging or terminating thereof so that a control signal is generated in response to said changing rate.

Accordingly the present invention provides an apparatus for controlling supercharger which comprises:

means for detecting the changing rate of accelerator position, a first comparator circuit, connected to an output of the detecting means to receive a signal representative of the changing rate of accelerator position, the comparator circuit comparing the output signal of said detecting means with a first given value, an arithmetic processing means processing an output signal of the first comparator circuit and at least one other parameter, the processing means being connected to an output of the first comparator circuit, driver means for driving a controlling mechanism of the supercharger in response to an output signal of the processing means, the driver means being connected to an output of the processing means, wherein the processing means generates a supercharging signal when said changing rate of accelerator position reaches the first given value while generating a supercharging-terminating signal according to said at least one other parameter after generating the supercharging signal.

In a first aspect of the present invention, said other parameter is time, and said processing means (or circuit) generates a supercharging-terminating signal when a predetermined period of time has lapsed after generating the supercharging signal.

In a second aspect of the present invention, said other parameter is the increasing rate of the engine rotational number (engine speed), and additional detector means for detecting the engine speed changing rate and a second comparator circuit comparing the engine speed increasing rate with a second given value are provided, wherein the processing means generates a supercharging-terminating signal according to an output signal of the second comparator circuit.

This second given value is determined relating to at least the accelerator position and gear shift position, preferably depending upon a function of at least accelerator position and gear shift position. More preferably, the second given value may be determined depending upon a function having as additional parameter(s) engine speed and/or vehicle speed.

For both the first and second aspects a supercharging-terminating signal can be generated corresponding to an output of a further detector means detecting the accelerator releasing rate through a further comparator circuit and said processing means when this accelerator releasing rate becomes a given value or higher. Namely, the processing means generates the supercharging-terminating signal when the accelerator changing rate becomes a negative third given value or less.

In the first aspect of the present invention the first comparator circuit and the arithmetic processing means may be composed as a comparing-processing circuit unit.

In both aspects, the detecting means of the changing rate of the accelerator position or throttle opening is comprised of, e.g., a differential circuit including a capacitor and a potentiometer operatively connected with an accelerator.

The comparator circuit comprises, for example, an operational amplifier and means for providing the first given value. The arithmetic processing means comprises a logic circuit. The driver means of the supercharger controlling mechanism may include, for example, an electromagnetic solenoid mechanism which opens and closes a throttle valve disposed in a bypass extending in parallel with the supercharger.

In the first aspect, the output from the differential circuit becomes the first given value or higher, the comparing-processing circuit unit generates a signal energizing the driver means when the depression speed of an accelerator pedal is higher than a predetermined value independently of the accelerator position. Accordingly, the solenoid mechanism will close the throttle valve in the bypass for the supercharger to some extent to initiate supercharging. The supercharging is terminated after it has been maintained by, e.g., a timer means for a predetermined period.

Generally, quick release of the accelerator pedal is carried out every time when the supercharging should be terminated. A supercharging terminating signal can be generated when the accelerator pedal release speed exceeds the second given value in accordance with the present invention.

The degree of supercharging (e.g., throttle valve opening) after the initiation of supercharging is controlled by known means depending upon the depression amount of the accelerator pedal (i.e., accelerator position).

In the abovementioned supercharger controlling apparatus, supercharging action is indirectly enhanced by closing the throttle valve in the bypass. Alternatively other supercharging throttle mechanisms may be of course used. For example it is possible that the rotational torque or number of compressors in the supercharger be directly controlled.

In accordance with the aforementioned structure the acceleration requirements by a driver are positively fulfilled and an improved fuel economy may be obtained since the supercharger responds to the changing rate of the accelerator positon, but does not respond to the accelerator pedal position.

In the second aspect of the present invention, the detecting means for detecting the changing rate of the accelerator position comprises a differential circuit and a potentiometer which is operatively connected with an accelerator pedal as is the case in the first aspect. The output from the differential circuit is input to the first comparator in which it is compared with the first given value. The means for detecting changing rate of the engine speed comprises, for example, a reed switch actuated by a magnet rotating in association with an engine output shaft, a digital/analog (D/A) converter and a differential circuit. The output of the differential circuit is compared in the second comparator with the second given value established by a function of parameters such as accelerator position, gear shift position, and vehicle speed etc. The output from the second comparator is fed to a logic circuit or one-chip microprocessor (i.e., processing means) which produces a control signal by executing a given program. The control signal from this logic circuit energizes the driver means for the supercharging mechanism, which in turn controllingly opens and closes the throttle valve provided, e.g., in the bypass extending in a parallel relationship with the supercharger. The throttle valve may be provided in a passage which communicates a passage between the compressor and the carburator with the atmosphere. The driver means can be also operated to change (increase and decrease) the rotary torque or rotational number of the compressor per se. Any other means which is capable of at least ON-OFF controlling may be used as the supercharging mechanism.

In the following, an embodiment in which a valve is provided in the bypass will be described. When the changing rate of the accelerator becomes the first given value or higher, a signal is generated from the comparator circuit and the logic circuit generates a signal enabling the driver circuit to completely of partially close the bypass to initiate supercharging. When the increasing rate of the engine speed or the acceleration of the vehicle becomes the second given value (or higher) established by the accelerator position, gear shift position and vehicle speed etc. following to depression of the accelerator pedal and supercharging, a signal deenergizing the driver means is output from the logic circuit.

Optionally and additionally it may be provided that the driver means energizing signal from the logic circuit can be terminated when the release speed of the accelerator pedal becomes a third given value or higher.

Accordingly, the supercharger of the present invention operates as mentioned hereinabove, it can effect supercharging only when the vehicle requires acceleration. As a result, acceleration running performance and fuel economy of the vehicle are improved. Furthermore supercharging may be automatically stopped in the preferred embodiment provided that acceleration suitable for the acceleration pedal position, gear shift position and vehicle speed is obtained resulting in further improvement in the running performance and fuel economy.

In the following, the present invention will be described with reference to the accompanyng drawings which are being presented or better illustration and not for limitative purpose.

DETAILED DESCRIPTION OF THE PREFERRED EMBODIMENTS

Embodiments of the supercharger controlling apparatus based on the first aspect of the present invention will be described with reference to the drawings. For ease of understanding the present invention the intake system incorporating a supercharger which is controlled by the apparatus of the present invention will now be described.

Figure 1:
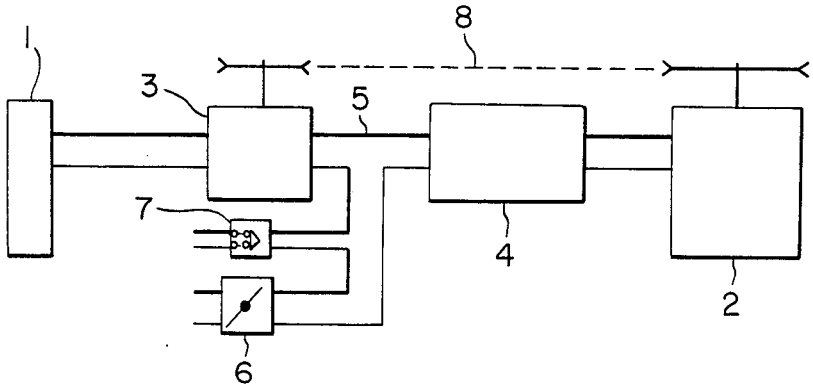
FIGS. 1 and 2 are schematic views each showing an intake system including supercharger.

Referring now to FIG. 1, there are successively provided a supercharger 3 and a carburetor 4 along a passage extending from an air cleaner 1 to an engine 2. The supercharger (compressor) 3 is of a vane or Root's type compressor which is always driven via a belt 8 by the engine 2. A passage 5 between the supercharger 3 and the carburetor 4 may be communicated with the atmosphere via a control throttle valve 6 or a relief valve 7. When the supercharging is not necessary, the valve 6 is opened to release the air compressed by the supercharger 3. When the supercharging is necessary, the valve 6 is closed depending upon the degree of the supercharging.

Figure 2:
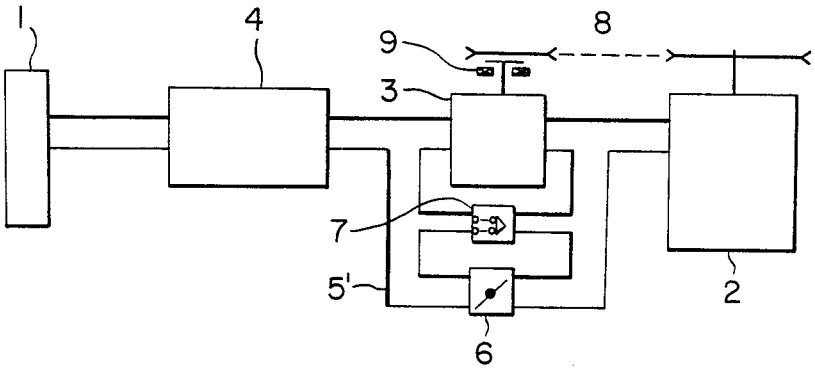

Referring now to FIG. 2, there is shown another intake system in which a carburetor 4 is disposed prior to the supercharger 3 along the passage between an air cleaner 1 and an engine 2. The supercharger 3 is also of vane or Root's type compressor and is driven by the engine 2 via a belt 8 and a clutch 9. When the supercharging is not required, the valve 6 in a bypass 5' is opened. When the supercharging is required, the bypass 5' is closed in a controlled degree.

Figure 3:
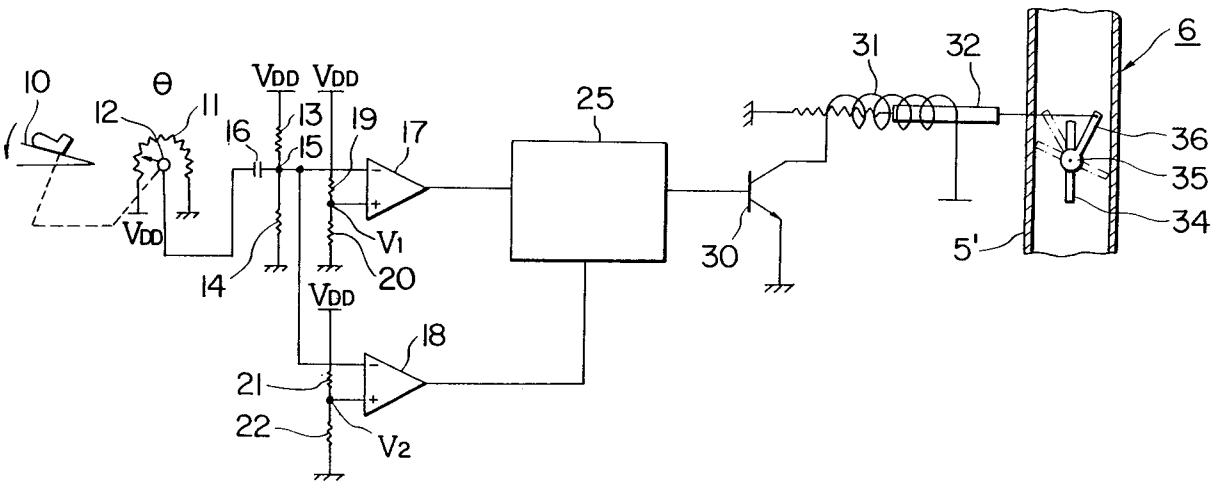
FIG. 3 is a diagram showing an embodiment of a supercharger controlling apparatus of the present invention.

Referring to FIG. 3, an accelerator pedal 10 is operatively connected with a rotary shaft 12 of a potentiometer 11. The rotary shaft 12 is rotated by means of a rack and pinion mechanism (not shown) when the pedal 10 is depressed. One of the fixed terminals of the potentiometer 11 is grounded and the other terminal is supplied with a power supply potential $+V_{DD}$ so that the voltage proportional to the pedal angle $\theta$ is output to a slidable contact.

A capacitor 16 is connected between the potentiometer 11 and a connection between the voltage dividing resistors 13 and 14. The capacitor 16 and the resistor 14 form a differential circuit. Voltage $V_{DD}/2$ plus voltage proportional to the changing rate of the pedal angle $\theta$ of the accelerator pedal $$\left(v \propto \frac{d\theta}{dt}\right)$$

is established at the connection 15 as shown in FIG. 3.

A comparator circuit at the next stage comprises first and second comparators 17 and 18. The voltage $$V_{DD}/2 + n\frac{d\theta}{dt}$$

Figure 4:
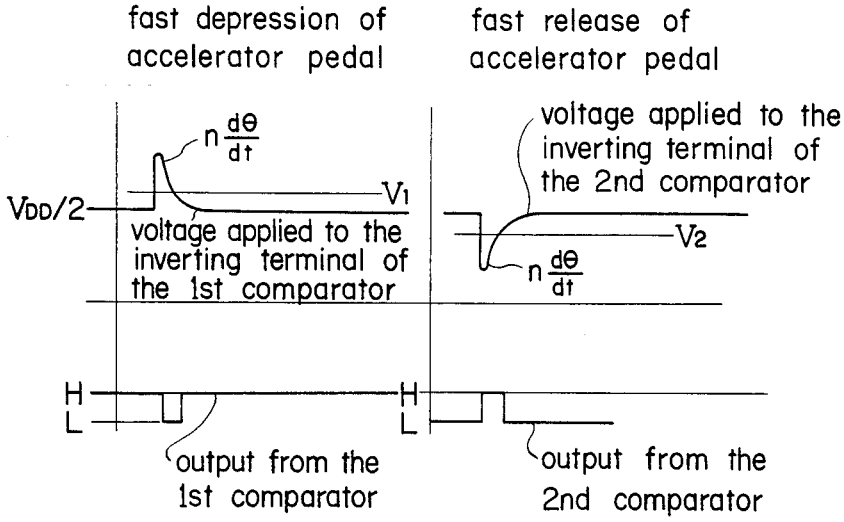
FIG. 4 is a wave chart showing the wave forms of signals applied to the inputs of the operational amplifier of the first and third comparator circuits shown in FIG. 3.

(wherein n is a constant) is applied to an inverting input terminal of the first comparator 17 and the voltage $V_1(V_1 > V_{DD}/2)$ divided by the resistors 19 and 20 is applied to the non-inverting terminal thereof. Accordingly the output of the first comparator 17 changes from H(high) to L(low) level when the pedal depression speed is so high that the voltage
is greater than $V_1$. the voltage $$V_{DD}/2 + n\frac{d\theta}{dt}$$

is greater than $V_1$. The voltage $$V_{DD}/2 - n\frac{d\theta}{dt}$$

is also applied to the inverting terminal of the second comparator 18 while a voltage $V_2$ ($<V_{DD}/2$) divided by the resistors 21 and 22 is applied to the other non-inverting terminal thereof. Therefore the output of the second comparator 18 changes from L to H level when the accelerator release speed is higher than a predetermined speed so that the voltage $$\left(V_{DD}/2 + n\frac{d\theta}{dt}\right)$$

is lower than $V_2$ as shown in the right side of FIG. 4. The comparator 18 may be omitted when the driving signal is deenergized only by timer control.

Figure 5:
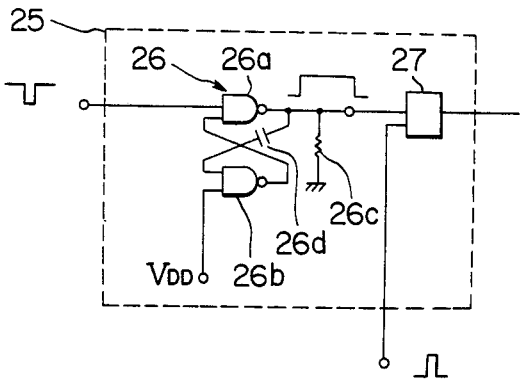
FIG. 5 is a diagram showing an example of the circuit shown in FIG. 3.
Figure 6:
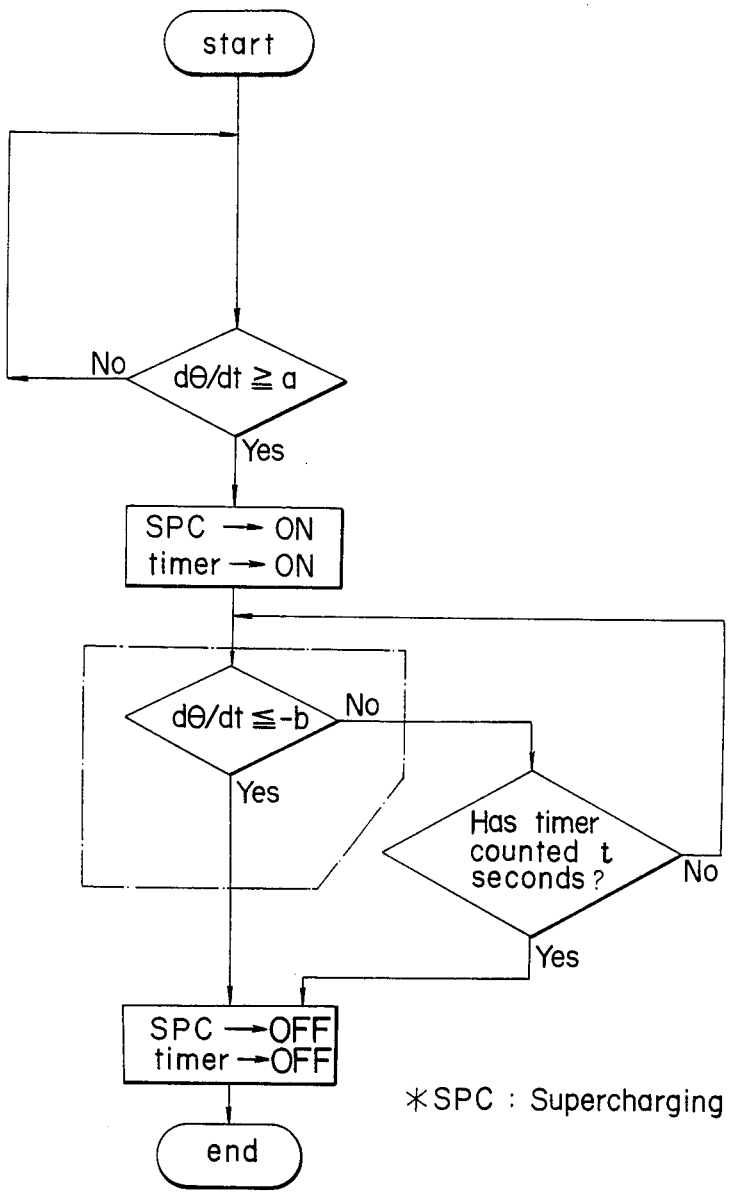
FIG. 6 is a flow chart showing a program executed in an operational circuit.

A logical operation circuit (logic and arithmetic processing circuit) 25 to which the outputs of the first and second comparators 17, 18 are supplied is adapted to execute a program shown in FIG. 6, e.g., the circuit 25 comprises a one-chip microprocessor. Alternatively it may be comprised of one-shot multivibrator (Multi) 26 and a gate circuit 27 as shown in FIG. 5.

The one-shot Multi 26 comprises two NAND circuits 26*a* and 26*b*. The one-shot Multi 26 generates a pulse having an H level to the next gate circuit 27 during a period of time determined by a time constant of a resistor 26*c* and a capacitor 26*d* when an L level pulse is input to the trigger terminal.

The output of the second comparator 18 is coupled with the other input terminal of the gate circuit 27. The logical operation circuit 25 outputs a pulse for a given period after a pulse has been generated from the one-shot Multi 26. If a pulse is generated from the second comparator 18 during this period, the circuit 25 ceases to generate the pulse.

A driver circuit at the next stage comprises a switching transistor 30 having a base electrode to which the output of the logical operation circuit 25 is connected; a solenoid 31 which is connected in series to the collector of the transistor 30; and a core 32 disposed movably due to energization of the solenoid 31. The core 32 is linked with an arm 36 secured to a pivotable shaft 35 which supports a throttle valve plate 34 of the control throttle valve 6 disposed in the bypass 5'.

Accordingly when a pulse is applied to the base electrode of the transistor 30, the transistor 30 becomes conductive to energize the solenoid 31. The core 32 is then attracted to rotate the throttle plate 34 in such a direction that the bypass 5' is closed. The supercharging action on the engine by the supercharger is enhanced.

That is to say, when the depression speed of the accelerator pedal 10 is higher than a given value, the control throttle valve 6 is closed for a given period of time to carry out supercharging. If the accelerator pedal 10 is released at a speed higher than a given speed during this period, the supercharging is terminated. If desired, the supercharging may be terminated only by a timer circuit through omitting both the second comparator 18 and the gate circuit 27 of the operation circuit 25. In such a case, the program portion encircled by a dot-dash line in FIG. 6 is omitted.

Figures 7, 8:
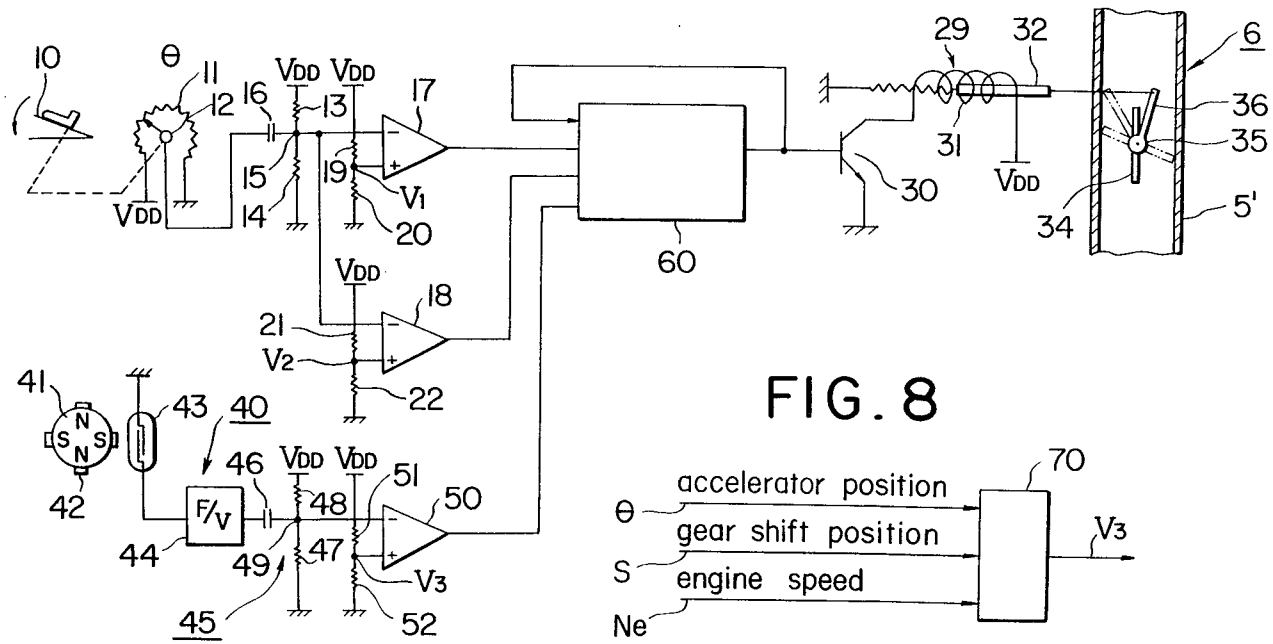
FIG. 7 is a circuit diagram showing another embodiment of a supercharger controlling apparatus of the present invention.
FIG. 8 is a diagram showing an example of a function generator with input and output.

Referring now to FIG. 7 there is shown another embodiment based on the second aspect of the present invention. The parts corresponding to those shown in FIG. 3 are designated with like reference numerals.

Since the acceleration detecting circuit shown in FIG. 7 is identical with that in FIG. 3 the description of this circuit is omitted.

In FIG. 7, the accelerator pedal 10 is operatively connected to the shaft 12 of the potentiometer 11, and the same output signal as in the case of FIG. 3 is generated at the output of the first and second comparators 17 and 18. Optionally, this second comparator 18 may be omitted so that the driving signal is deenergized only by the third comparator 50 which responds to, e.g., engine speed etc.

A detector 40 for detecting the changing rate of the engine speed comprises a reed switch 43 which is closed or opened by a magnet 42 secured to an output shaft 41 of the engine, a frequency/voltage (F/V) convertor 44 which converts the frequency of opening/closing of a reed switch 33 into voltage, and a differentiator 45 for differentiating the output of the F/V convertor 44. The differentiator 45 comprises a capacitor 46 and a resistor 47. A voltage $V_{DD}/2$ which is a division of the voltage of the power source is established at a connection 49 between the equal resistors 47 and 48.

The divided voltage $V_{DD}/2$ is constantly applied to an inverting input terminal of the third comparator 50 while a voltage $V_3$ which is a voltage divided by resistors 51 and 52 is applied to a non-inverting terminal thereof. Accordingly a voltage $$V_{DD}/2 + m\frac{dV}{dt}$$

(wherein m is a constant) is applied to the inverting input terminal when the output from the converter 44 changes depending upon the change of dV/dt. Therefore the output from the third comparator 50 changes from H to L level when the voltage $V_3$ satisfies the equation $$V_{DD}/2 + m\frac{dV}{dt} \geqq V_3$$

with the increase in the engine speed Ne.

In FIG. 7 the voltage $V_3$ is preset to a given value by a combination of equal resistors 51 and 52. However, it is more preferable that this voltage $V_3$ be a function of parameters such as acceleration pedal position $\theta$, gear shift position S, vehicle speed U or engine rotation speed Ne ($f=f(\theta, S)$, $f(\theta, S, U)$, $f(\theta, S, Ne)$ or $f(\theta, S, U, Ne)$). A function generator 70 to which parameters are input generates the voltage $V_3$ as an output.

Figure 9:
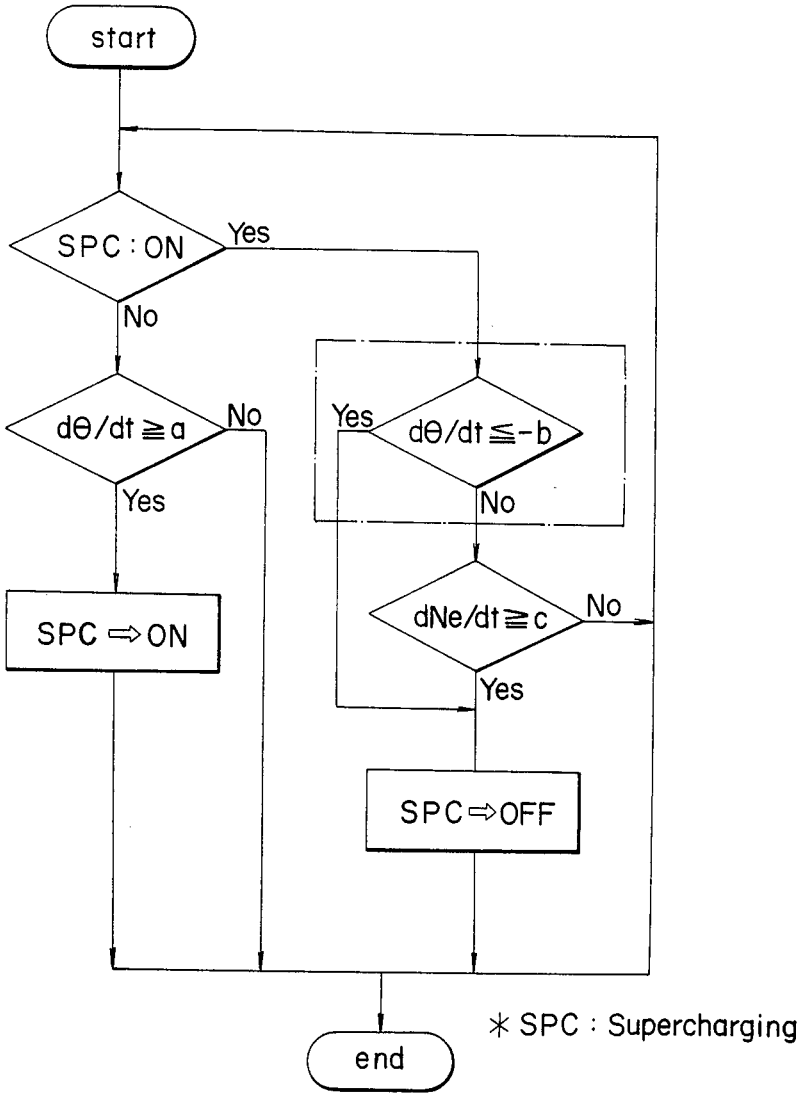
FIG. 9 is a flow chart showing a program executed in the logic and operational circuit as shown in FIG. 7.

Outputs of the first, second and third comparators 17, 18 and 50 are connected to a logical operation circuit or one-chip microprocessor 60. A program shown in FIG. 9 is executed in the microprocessor 60. As a result of this program execution, the microprocessor 60 produces driving (actuating) signal to a next driver when the first comparator 17 generates an L level pulse. When the accelerator pedal depression speed is higher than a given value the driving signal is generated. When the accelerator pedal release speed is higher than a predetermined value while the driving signal is generated so that an H level signal is input to the second comparator 18, or alternatively when the increasing rate of the engine speed or the vehicle acceleration becomes higher than a predetermined value so that an L level signal is generated from the third comparator 50, the application of the driving signal is terminated.

The description of the driver circuit 29 and the control throttle valve 6 is omitted since they are identical with those of FIG. 3.

When the depression speed of the accelerator pedal 10 is higher than a predetermined value the control throttle valve 6 is closed to carry out the supercharging. When the accelerator pedal 10 is released at a speed higher than a predetermined value, or when the increasing rate of the engine speed or vehicle acceleration becomes higher than a predetermined value, the control throttle valve 6 is opened again to terminate the supercharging. If desired, the supercharging may be terminated only when the increasing rate of the engine speed becomes higher than a predetermined value by omitting the second comparator 18 as mentioned above. In this case, the program shown in FIG. 9 in which the step encircled with a dot-dash line is omitted is executed.

Figure 10:
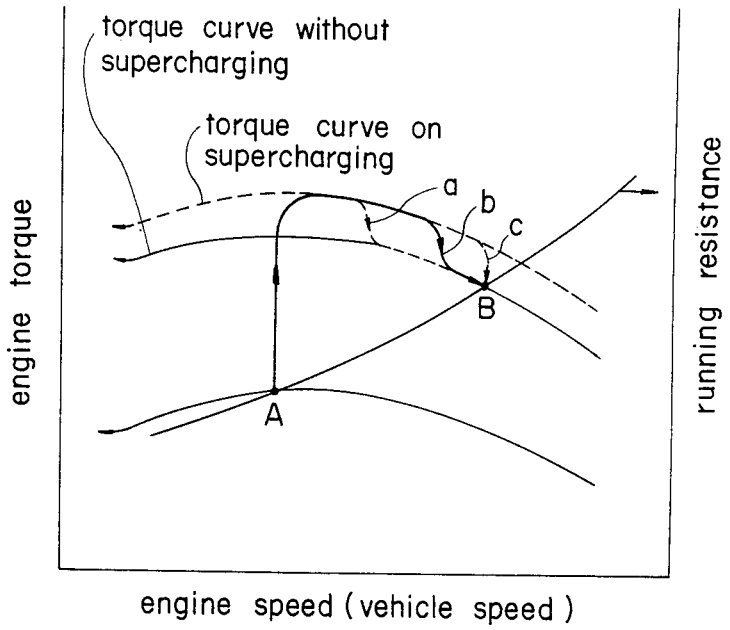
FIG. 10 is a graph showing the torque curve with respect to the engine speed when the supercharging is effected in response to the increase in running resistance.

An engine torque curve b was plotted based on measurement when the supercharging was terminated by the apparatus of the present invention just after the increasing rate of the engine speed has reached a predetermined value. Engine torque curves a and c were also plotted based on measurements for the earlier and later termination of supercharging respectively as shown in FIG. 10. Points A and B correspond to the start of the supercharging and the termination of the acceleration, respectively.

The curves show that the supercharging is terminated slightly prior to the point B in accordance with a preferred embodiment of the present invention. Therefore ideal acceleration may be obtained and unnecessary accelerator operation, such that has been usually done with the conventional arrangements in the case where the acceleration is insufficient, can be avoided. Premature termination of the supercharging causes adverse acceleration so that acceleration operation should be done once more. The late termination of the supercharging causes excessive fuel consumption and unfavorable running performance or supercharging operation characteristics.

The superchargers of the aforementioned embodiments are of the vane or Root's type (volume type) which is directly driven by the engine output torque. Alternatively, the supercharger may be a turbine type supercharger commonly called a turbocharger as shown in FIG. 11.

Figure 11:
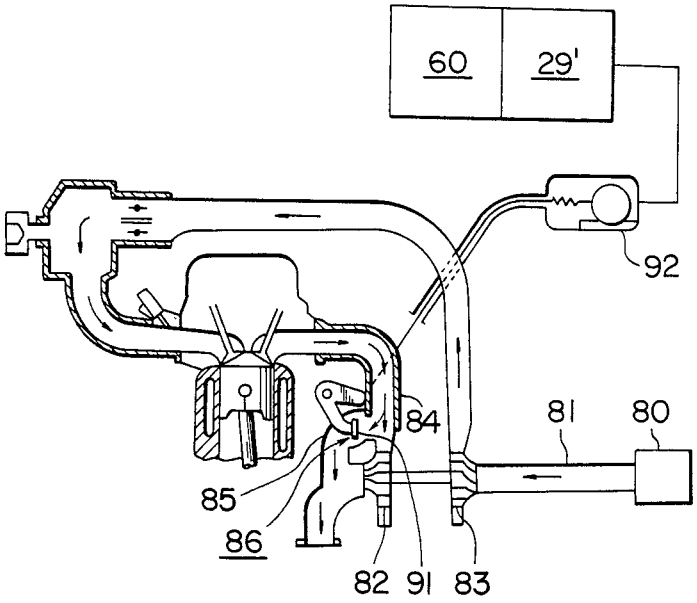
FIG. 11 is a schematic view showing an intake system in which the supercharger is a turbocharger.

Referring now to FIG. 11, there is shown a turbocharger comprising an intake compressor 83 and a exhaust gas turbine 82 coaxial thereto. The intake compressor 83 which is interposed in an intake passage 81 downstream of an air cleaner 80 is driven by the exhaust gas turbine 82. An exhaust bypass 85 is provided in an exhaust passage 84 which bypasses the exhaust turbine 82. An exhaust gas gate valve 86 is interposed in a passage 85 for controlling the flow rate of supercharging air. The exhaust gas valve 86 is actuated in response to the rotation of an electric motor (e.g., step motor) 92 to open and close, the motor being driven by an output of a driver circuit 29'.

According to the present invention any modification suitable for practical use of the inventive arrangement may be done without departing from the concept as disclosed and the scope as claimed in the Claims as hereinbelow set forth.

What is claimed is:

1. Apparatus for controlling a supercharger on an engine whose speed is regulated by an operator-actuated accelerator, comprising:

means for detecting the rate of change of the position of the accelerator;

means for comparing the detected rate of change of accelerator position with first and second reference values and providing a signal related to whether the detected rate of change is less than each of said reference values;

means responsive to the signal from said comparing means for generating a supercharging signal when the detected rate of change of position of the accelerator in one direction of movement is greater than said first reference value and for generating a termination signal when the detected rate of of change of position of the accelerator in the opposite direction of movement is greater than said second reference value; and means responsive to the signals from said signal generating means for controlling the supercharger to selectively supply compressed air to the engine.

2. The apparatus of claim 1 wherein said signal generating means includes means for generating said termination signal a predetermined time period after the generation of a supercharging signal.

3. Apparatus for controlling a supercharger on an engine whose speed is regulated by an operator-actuated accelerator, comprising:

means for detecting the rate of change of the position of the accelerator;

means for comparing the detected rate of change of accelerator position in one direction of movement with a first reference value and providing a signal related to whether the detected rate of change is less than said first reference value;

means for detecting the rate of change of the speed of the engine;

means for comparing the detected rate of change of engine speed with a second reference value and providing a signal related to whether the detected rate of change is less than said second reference value;

means responsive to the output signals from each of said comparing means for generating a supercharging signal when the detected rate of change of accelerator position is greater than said first reference value and generating a terminating signal when the detected rate of change of engine speed is greater than said second reference value; and means responsive to the signals from said signal generating means for controlling the supercharger to selectively supply compressed air to the engine.

4. The apparatus of claim 3 further including means for comparing the detected rate of change of accelerator position in the opposite direction of movement to a third reference value and providing a deceleration signal related to whether the detected rate of change is greater than the third reference value, said signal generating means being responsive to said deceleration signal to generate said terminating signal when the detected rate of change of accelerator position in said opposite direction of movement is greater than said third reference value.

5. A method for controlling the operation of a supercharger on an engine whose speed is regulated by an operator-actuated accelerator, comprising the steps of:

detecting the rate of change of position of the accelerator;

determining whether the detected rate of change in one direction of movement is equal to or greater than a first threshold value;

activating the supercharger to supply compressed air to the engine when the detected rate of change is equal to or greater than said first threshold value;

determining whether the detected rate of change in the opposite direction of movement is greater than or equal to a second threshold value;

deactivating the supercharger to terminate the supply of compressed air to the engine when the detected rate of change is greater than or equal to the second threshold value;

determining whether a predetermined period of time has elapsed since activation of the supercharger; and deactivating the supercharger at the end of said period of time.

6. A method for controlling the operation of a supercharger on an engine whose speed is regulated by an operator-actuated accelerator, comprising the steps of:

detecting the rate of change of position of the accelerator;

determining whether the detected rate of change in one direction of movement is equal to or greater than a first threshold value;

actuating the supercharger to supply compressed air to the engine when the detected rate of change is equal to or greater than said first threshold value;

determining whether the rate of change of speed of the engine is greater than or equal to a second threshold value; and deactivating the supercharger to terminate the supply of compressed air to the engine when the rate of change of engine speed is greater than or equal to said second threshold value.

7. The method of claim 6 further including the steps of determining whether the rate of change of accelerator position in the opposite direction of movement is greater than or equal to a third threshold value, and deactivating the supercharger when the rate of change of accelerator position in said opposite direction is greater than seaid third threshold value.

8. The method of claim 6 wherein said second threshold value is variable in accordance with at least one of accelerator position, engine speed and position of a gear shift associated with the engine.

* * * * *